US005244145A

United States Patent [19]

Forbes, Jr.

[11] Patent Number: 5,244,145

[45] Date of Patent: Sep. 14, 1993

[54] TWO WAY OPENING FOR A TRAY TYPE CARTON

[75] Inventor: Hampton E. Forbes, Jr., Newark, Del.

[73] Assignee: Westvaco Corporation, New York, N.Y.

[21] Appl. No.: 28,803

[22] Filed: Mar. 10, 1993

[51] Int. Cl.[5] ..... B65D 5/42

[52] U.S. Cl. ..... 229/125.35; 206/459.5; 729/245

[58] Field of Search ..... 229/125.35, 245; 206/459.5

[56] References Cited

U.S. PATENT DOCUMENTS

| | | | |
|---|---|---|---|
| 2,649,392 | 8/1953 | Marshall | 229/125.35 |
| 3,108,708 | 10/1963 | Betner | 229/125.35 |
| 3,300,117 | 1/1967 | Kossnar | 229/125.35 |
| 3,398,876 | 8/1968 | Ward | 229/125.35 |
| 3,515,334 | 6/1970 | Jacobson | 229/125.35 |
| 3,580,490 | 5/1971 | Shaad | 206/459.5 |
| 4,183,458 | 1/1980 | Meyers . | |
| 4,351,473 | 9/1982 | Manizza | 229/125.35 |
| 4,531,668 | 7/1985 | Forbes, Jr. | 229/125.35 |
| 4,871,071 | 10/1989 | Zimmermann | 229/125.35 |
| 4,944,451 | 7/1990 | Forbes, Jr. | 229/125.35 |
| 4,955,530 | 9/1990 | Rigby et al. | 229/125.35 |

*Primary Examiner*—Gary E. Elkins

[57] ABSTRACT

A venting/opening scheme for tray type cartons, wherein the tray has a continuous, upper peripheral flange to which a lid is bonded, and the tray includes opening instructions printed on a side wall for opening one of two adjacent corners of the tray, the improvement wherein a venting/opening means is applied to the tray flange at both of the two adjacent corners of the tray where the opening instructions are printed. The application of a venting/opening means at each corner allows the cartons to be opened by peeling the lid off from left-to-right or from right-to-left. The venting/opening means comprises partial depth cut lines located in the underside of the tray flange at each adjacent corner of the tray. The partial depth cut lines allow the portion of the tray flange outboard of the cut lines to be broken away from the continuous flange and used to lift the corner of the lid, thereby interrupting the bond between the lid and flange for venting and opening the carton 4 Claims, 4 Drawing Sheets

TWO WAY OPENING FOR A TRAY TYPE CARTON

BACKGROUND OF INVENTION

The users of cartons as disclosed and claimed herein often have different criteria for how their products are best presented in the marketplace. This criteria may include shape, size and how the carton is to be opened for use. The object is to make cartons of a particular user unique and different from the cartons of its competitor to achieve brand recognition. For these reasons, the manufacturers of such cartons must maintain a number of cutting dies on hand for die cutting and printing the various carton designs requested.

In recent years, many carton users have settled upon a fundamental tray design for such cartons which is known in the trade as a Sprinter tray. The Sprinter tray is used for entrees, vegetables, desserts and the like. The tray is generally formed in the shape of a rectangle with two side walls and two ends walls connected to a bottom wall. The corners of the tray (i.e., the adjacent ends of the respective end and side walls), are connected together by full height gusset panels to make the tray substantially liquid tight. Each of the side and end walls are provided with flanges at their upper edges and at least one of the gusset panels at each corner includes a flange portion which is bonded to overlapping extensions of the side and end wall flanges when the tray is formed. During the tray formation, the gusset panels at each corner are also bonded together and folded for bonding to an end or side wall. A lid is provided for the tray which fully overlaps the tray flange and is bonded thereto after the tray is filled. The lid may be separate from the tray or may be integral with the tray, in which case a flange may be omitted along the side of the tray to which the lid is attached. Nevertheless, despite settling upon a fundamental tray design, users still want their cartons to standout in the marketplace.

To achieve this result, some users specify that their cartons open by removing the lid in a left-to-right motion, while others specify a right-to-left opening scheme. In order to accommodate both such users while minimizing the number of dies which must be purchased and maintained by the manufacturer, the present invention was developed.

The most fundamental means for venting and opening cartons of the type disclosed herein has been the simple use of a knife or other sharp object for cutting the lid. Many such cartons include dotted lines printed on the lid surface indicating where the lid can be cut. However, this has not proven to be a completely satisfactory method and a number of alternatives have been developed. In any scheme for opening such cartons, where the lid is removed, the lid must either de-bond to the flange, or a portion of the flange must de-bond to the lid. U.S. Pat. No. 4,183,458 discloses such a technique where either the tray o the lid is applied with cut lines for breaking away when the carton is opened. Other U.S. patents which disclose related venting and opening schemes include U.S. Pat. Nos. 4,871,071 and 4,955,530 where the venting and opening scheme is applied only to the lid at one corner. In addition, the applicant herein has two pending patent applications (U.S. application Ser. Nos. 07/831,991 and 07/925,745) which disclose structures related to the present invention. The prior art opening and venting schemes are each satisfactory to some extent, but they fail to address the problem solved by the present invention.

SUMMARY OF INVENTION

The present invention is designed to address the problems faced by the manufacturers of tray-type ovenable cartons regarding the inventory of cutting dies needed to manufacture the cartons for different users. The venting and opening means described herein involves primarily a lifting action that allows cartons to be opened with either a left-to-right motion or a right-to-left motion. For this purpose, a single cutting die is used to apply partial depth cut lines to the underside of the tray flanges at each of two adjacent corners of the tray along one side wall. U.S. Pat. No. 4,183,458 discloses the use of micro cuts in a tray flange at one corner of a carton for opening a carton, but no consideration is given to the application of instructions on the tray or lid for opening the carton. If opening instructions are printed on either the lid or the tray the instructions must appear at the corner where the micro cuts are located. In accordance with the present invention, by applying microcuts at two adjacent corners of the same side wall, the opening instructions may be printed on the tray at either corner or at both corners. This relieves the user from any obligation of aligning the lids and trays during the sealing step.

DETAILED DESCRIPTION

Figure 1:
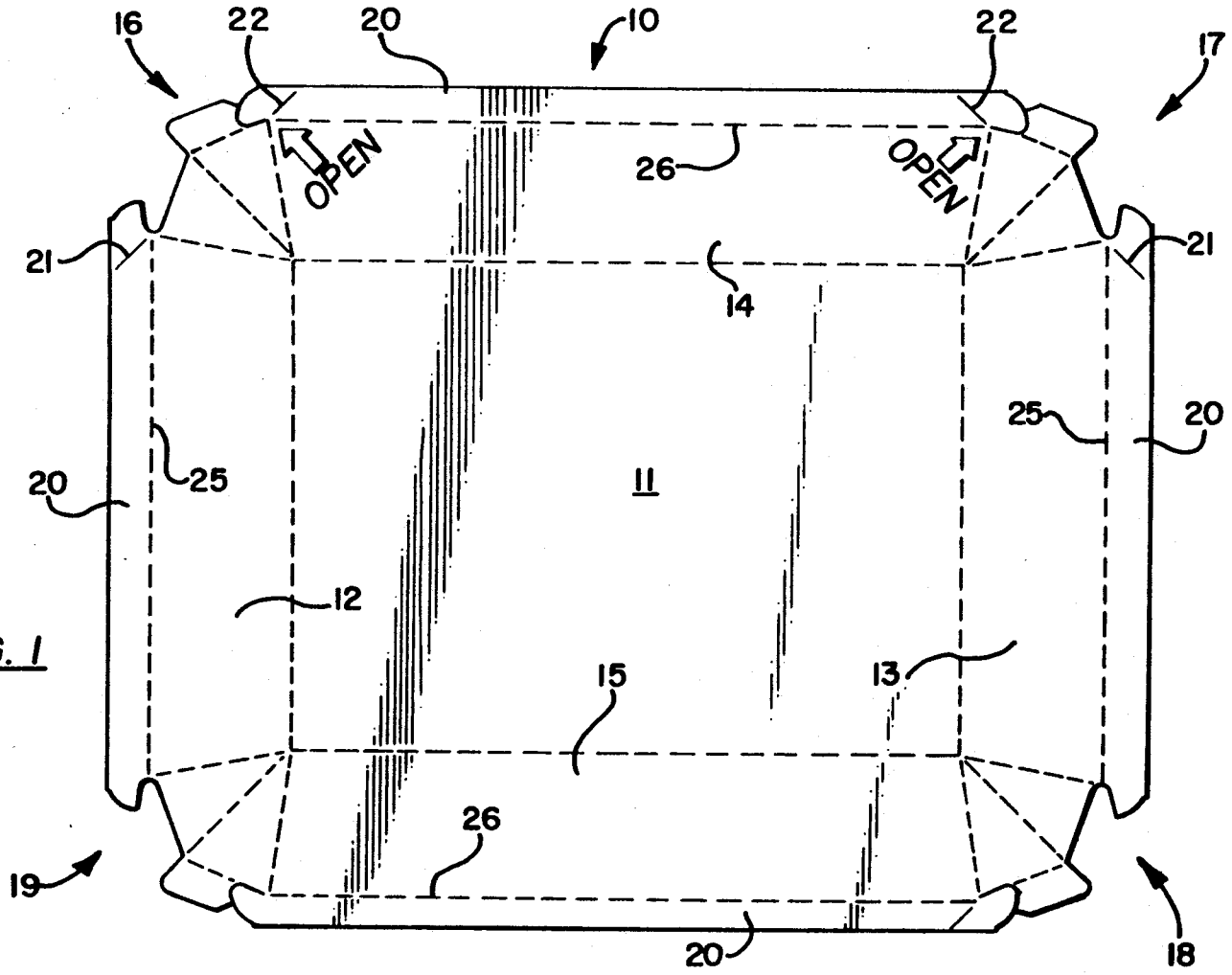
FIG. 1 is a top plan view of a typical blank structure for forming the tray of the present invention with an OPEN designation printed at each of two adjacent corners of the tray blank along one side.

Referring to the drawing, and more particularly to FIG. 1, a typical blank structure 10 is illustrated which includes a bottom panel 11, opposed end walls 12, 13 connected to the ends of the bottom panel 11, and opposed side walls 14, 15 foldably connected to the opposed sides of the panel 11. Gusset panels 16, 17, 18 and 19 are foldably connected between the ends of the end and side walls. Meanwhile, each of the end walls, side walls, and at least one gusset panel at each corner, includes an outwardly extended flange portion 20.

Figure 2:
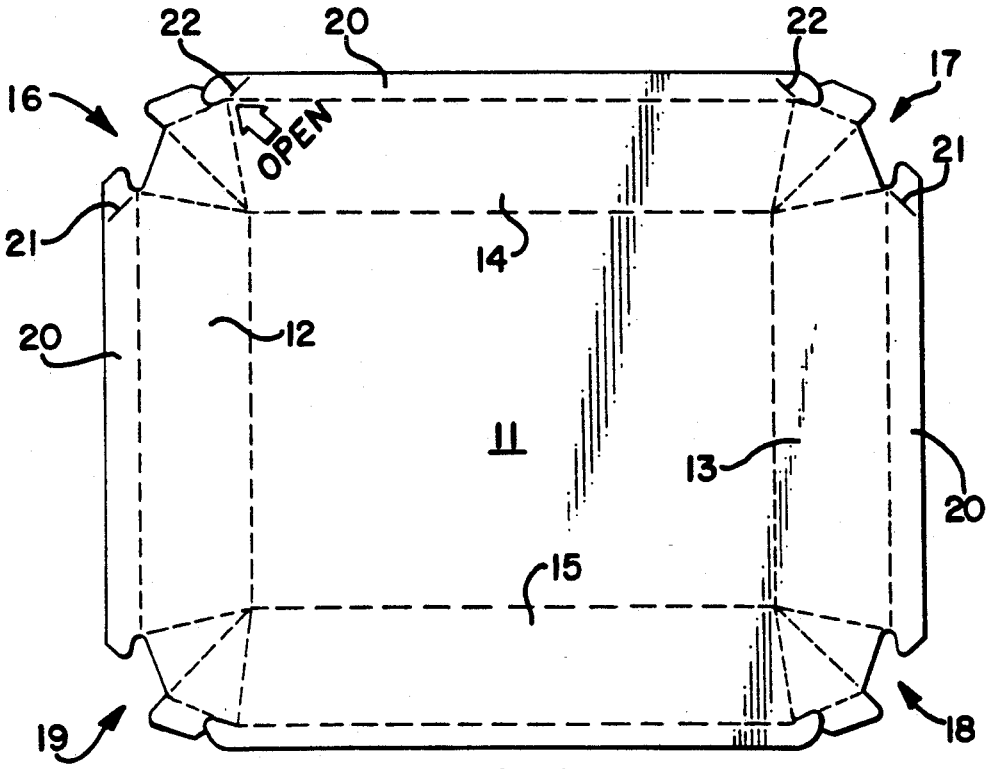
FIG. 2 is a view similar to FIG. 1 with an OPEN designation printed at the left corner along one side wall.

The opening feature of the present invention is provided at two adjacent corners 16 and 17 of the tray blank 10 in the form of micro-cuts 21, 22 applied to the underside of the flange 20. In FIG. 1, the designation OPEN is printed on the tray side wall 14 at each corner 16, 17 to inform the user that a carton formed from the blank may be opened from either end. In FIG. 2, the blank 10 includes the designation OPEN only at the left corner 16 to provide an opening from left-to-right, and in FIG. 3, the blank has the designation OPEN printed only at the right corner 17 for opening right-to-left.

Figure 4:
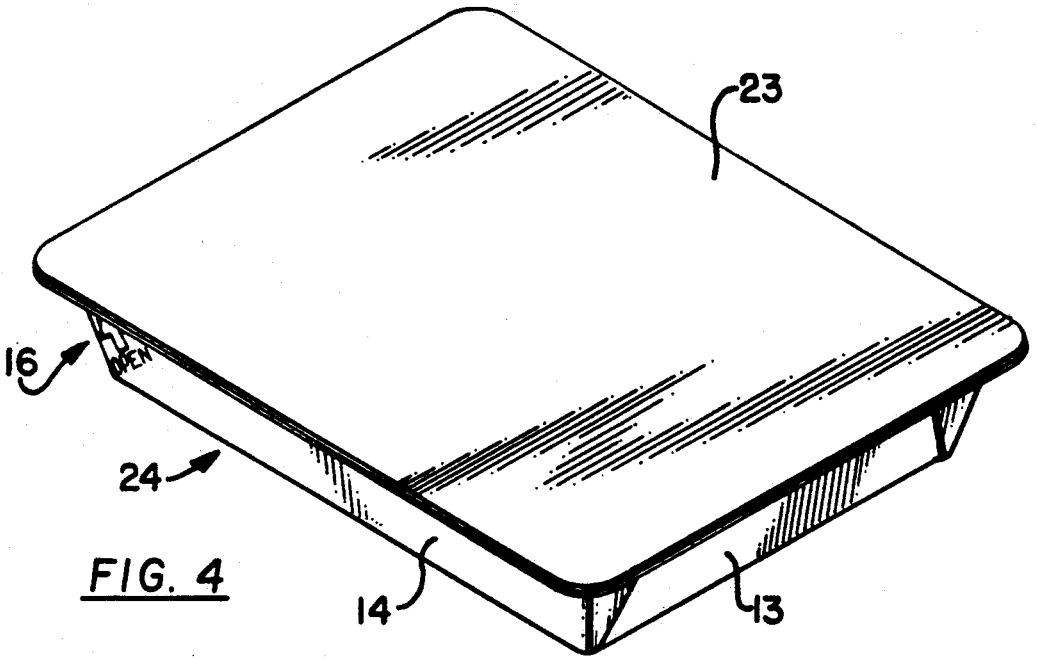
FIG. 4 is a perspective review of a tray type carton prepared from the blank of FIG. 2 with the OPEN designation at the left corner for opening left-to-right.
Figure 5:
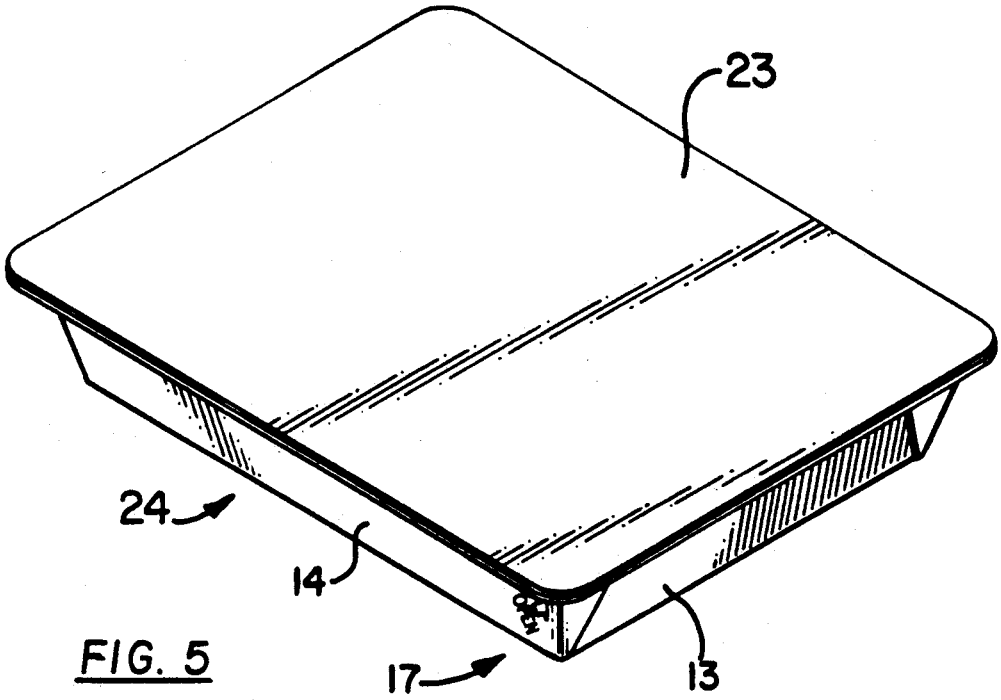
FIG. 5 is a perspective view similar to FIG. 4 for opening right-to-left.
Figure 6:
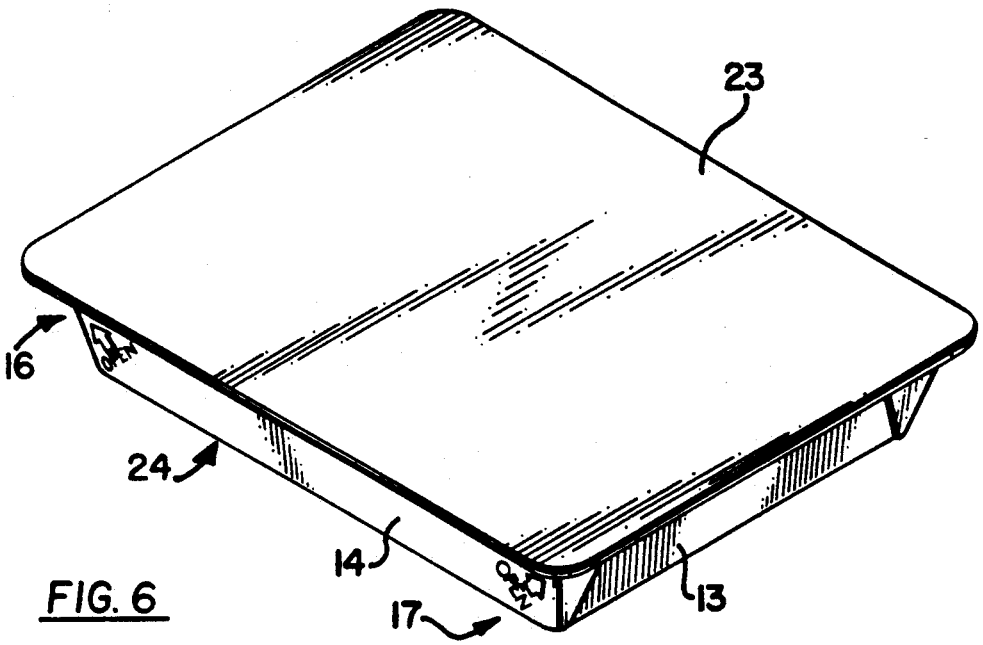
FIG. 6 is a perspective view similar to FIGS. 4 and 5 with OPEN designations printed at two adjacent corners along a side wall; and, FIG. 7 is a perspective view of the carton of FIG. 6 with both OPEN corners broken off to remove the lid.

The blank 10 is preferably prepared from a single sheet of flexible paperboard material which is coated with a heat resistant coating with the gusset corners 16, 17, 18 and 19 providing leakproof corners. The lid 23 is also formed from a single blank of flexible paperboard, and as shown in FIGS. 4–6, has dimensions which overlap the peripheral flange 20 of the tray 24 where it is bonded. In FIG. 4, the designation OPEN is printed on the side wall 14 of the tray at the upper left corner 16. For this embodiment, the lid 23 would be opened from left-to-right by grasping the corner of the lid, and separating the corner of the tray flange 20 from the remainder of the tray by fracturing the micro-cuts 21, 22 and peeling the lid back. The embodiment in FIG. 5 is opened in the same fashion by peeling the lid back in a right-to-left motion.

Figure 3:
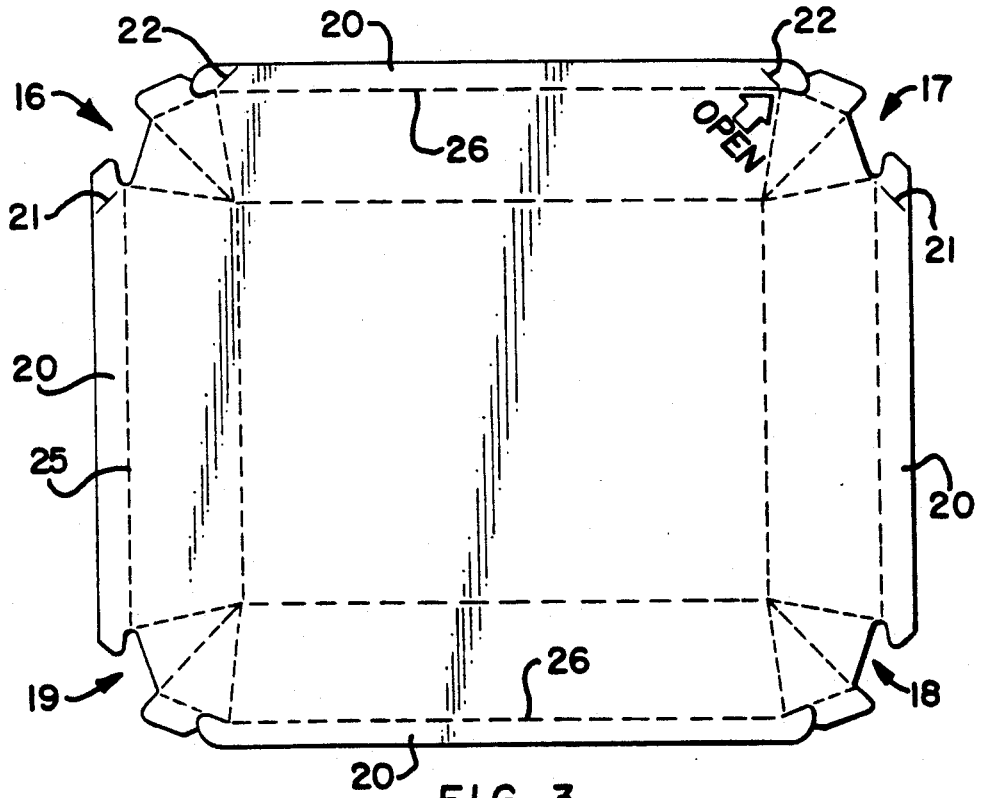
FIG. 3 is a view similar to FIG. 1 with an OPEN designation printed at the right corner along one side wall.
Figure 7:
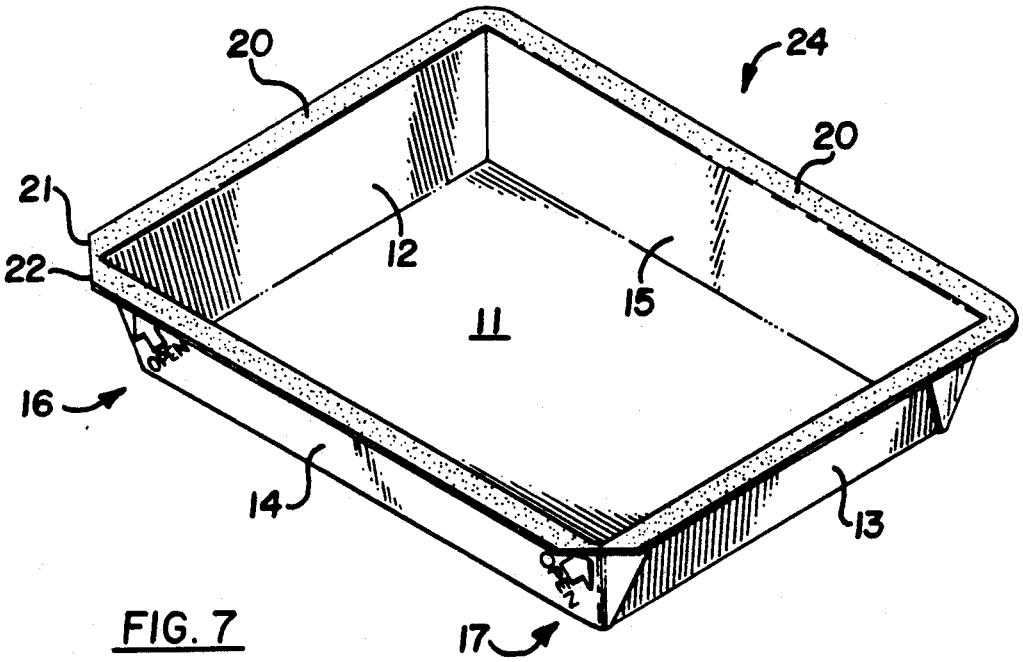

The embodiment shown in FIGS. 6 and 7 includes the designation OPEN printed at two adjacent corners 16 and 17 along the side wall 14. For this embodiment, the carton may be opened from either corner, i.e., from left-to-right by peeling the lid back from corner 16 or from right-to-left by peeling the lid back from corner 17. The tray 24 is shown in FIG. 7 with the lid removed. In this view, both corners 16, 17 have been fractured along micro-cuts 21, 22 for opening the carton. Thus, the carton construction of the present invention does not require any opening instructions to be printed on the lid, and accordingly, there is no requirement for matching the lids with the trays to assure a reliable opening scheme. When the lid is removed, or partially removed for venting the carton, delamination between the lid 23 and flange 20 may be accomplished in one of two ways. If it is desired for the flange to delaminate to the lid, cut/score lines or micro-cuts (not shown) may be applied to the tray near or at the location of the fold lines 25 and 26 connecting the tray flange 20 to the upper edges of the tray end walls 12, 13 and side walls 14, 15 as shown in FIG. 1–3. If it is desired to delaminate the lid to the tray flange 20, cut/score or micro-out lines (not shown) are applied to the underside of the lid at a location substantially coincident with a point that is opposite the fold lines 25 and 26 of the tray when the lid is in place. These lines of separation would extend around the entire periphery of the tray flange 20 if the lid was to be entirely removed. For a carton with an integral lid, the lines of separation would need only be applied to all portions of the carton except for the location where the lid remained attached to the tray.

The present invention provides a great degree of versatility for both the carton manufacturer and the user of the cartons. By printing opening instructions on the tray side wall, and applying the opening means to the tray, there is no need for matching a lid with opening instructions on the tray when the cartons are sealed. Moreover, by incorporating the opening means at two adjacent corners along a side wall, a single manufacturing die may be used for customers who want a left hand opening, a right hand opening, or the convenience of two way opening. Unlike the prior art cartons with opening schemes or instructions applied to the lid, the present invention provides a more reliable and desirable method for achieving the same result. In its most preferred embodiment, the present invention is applied to rectangular shaped, tray type cartons with a separate lid and tray. However, the features of the present invention could just as readily be applied to cartons of any polygonal shape, or to cartons of the integral lid and tray type. Thus, even though only the most preferred embodiments are fully disclosed herein, it will be understood that the invention could be applied to other structures within the scope of the appended claims.

What is claimed is:

1. A paperboard carton having a substantially polygonal shape comprising a tray having at least two adjacent corners and including a bottom panel and a plurality of upstanding side walls at least one of which connects the two adjacent corners of the tray, said tray including an outwardly extending flange, and a lid having a marginal edge portion which overlies the tray flange and is bonded thereto for closing the carton, the improvement for venting and opening the carton at either of the two adjacent corners of the tray comprising partial depth micro cuts applied to the underside of the tray flange at the two adjacent corners of the tray, said micro cuts defining removable portions of the tray flange outboard from the micro cuts whereby the carton may be opened by a user from either of the two adjacent corners.

2. The paperboard carton of claim 1 wherein the word OPEN is printed on the side wall of the tray at one of the two adjacent corners to designate opening instructions for the carton.

3. The paperboard carton of claim 1 wherein the word OPEN is printed on the side wall of the tray at the other of the two adjacent corners to designate opening instructions for the carton.

4. The paperboard carton of claim 1 wherein the word OPEN is printed on the side wall of the tray at both of the two adjacent corners to designate opening instructions for the carton.

* * * * *

UNITED STATES PATENT AND TRADEMARK OFFICE

CERTIFICATE OF CORRECTION

PATENT NO. : 5,244,145

DATED : September 14, 1993

INVENTOR(S) : Hampton E. Forbes, Jr.

It is certified that error appears in the above-indentified patent and that said Letters Patent is hereby corrected as shown below:

Column 4, line 45, "claim 1" should read --claim 2--.

Signed and Sealed this

Twenty-sixth Day of August, 1997

*Attest:*

Bruce Lehman

BRUCE LEHMAN

*Attesting Officer*

*Commissioner of Patents and Trademarks*